US006581682B1

(12) United States Patent
Parent et al.

(10) Patent No.: US 6,581,682 B1
(45) Date of Patent: Jun. 24, 2003

(54) EXPANDABLE BOREHOLE PACKER

(75) Inventors: John Howard Parent, Brampton (CA); James G. Pianosi, Toronto (CA); Jamieson Edward Champ, Georgetown (CA)

(73) Assignee: Solinst Canada Limited, Georgetown (CA)

( * ) Notice: Subject to any disclaimer, the term of this patent is extended or adjusted under 35 U.S.C. 154(b) by 105 days.

(21) Appl. No.: 09/670,389

(22) Filed: Sep. 28, 2000

(30) Foreign Application Priority Data

Sep. 30, 1999 (GB) ..... 9923092

(51) Int. Cl.[7] ..... E21B 33/12
(52) U.S. Cl. ..... 166/180; 166/119
(58) Field of Search ..... 166/228, 235, 166/236, 119, 180, 195

(56) References Cited

U.S. PATENT DOCUMENTS 4,065,392 A * 12/1977 Gammon ..... 210/282
5,195,583 A * 3/1993 Toon et al. ..... 166/179
6,416,661 B1 * 7/2002 Cordry ..... 166/228

* cited by examiner

*Primary Examiner*—David Bagnell
*Assistant Examiner*—Jennifer Dougherty
(74) *Attorney, Agent, or Firm*—Anthony Asquith & Co.

(57) ABSTRACT

The borehole packer is for sealing the annular space around a pipe in a borehole. The packer is pre-manufactured, in-factory. To give the packer the rigidity it needs for handling and transport, the packer is built around an inner sleeve of rigid (metal) mesh. Alternatively, the packer may be built around a cardboard tube, which is discarded as the packer is assembled onto the pipe. When the packing material is bentonite, the bentonite may be compression-moulded into annular-rings, and the packer is built up from the rings.

32 Claims, 5 Drawing Sheets

EXPANDABLE BOREHOLE PACKER

This invention relates to the placement of instruments in boreholes in the ground. For example, the invention can be applied when placing water-quality instrumentation and sampling apparatus in a water monitoring well, and the invention will be described as it relates to that application.

In this type of operation, a pipe is passed down from the ground surface into the borehole. The pipe serves as a housing for one or more tubes, which lead down to the sampling points, generally under water, in the borehole.

BACKGROUND TO THE INVENTION

Often, the pipe is, say, half the diameter of the borehole. The need arises for sealing the annulus around the pipe, to prevent an up/down flow of water.

One of the parameters the designer should have in mind when designing a water sampling and instrumentation system is the need to make sure that the water drawn up when taking a sample actually does come from the depth indicated. If water is allowed to pass easily up and down the borehole, more readily than water can naturally flow up/down in the surrounding ground, a reading taken at depth A might actually be measuring water that comes from depth B.

The requirement arises, therefore, for a means for sealing off the sampling point at a certain depth, from water at other depths. Conventionally, packing seals of various types and designs have been used and proposed for this purpose.

The seal, or packer, must expand to fill the annular (radial) gap between the pipe and the borehole, after the pipe has been lowered into the borehole. The use of bentonite for sealing pipe-to-borehole gaps has long been favoured, because bentonite expands upon immersion in water. The bentonite is in a dry condition when it is lowered into position in the borehole, and then the bentonite is left to expand, as it becomes exposed to, and is penetrated by, the water in the borehole.

The present invention provides a packing or sealing system, which is aimed at enabling the seal material, such as bentonite, to be placed around the pipe, at the desired depth in the borehole, in a manner whereby it is considerably easier to achieve the desired security of seal, with less skill and care required of the installer, than has been the case with conventional packing systems.

It is recognised that the system of the invention can also serve as a means for installing materials other than expandable or inflatable sealing materials, such as sand/gravel or other porous materials, where these are needed, accurately at a specified depth, in a borehole. Where the pipe has a sampling port in the pipe, for example, it is conventional for a screen of sand or gravel to be packed around the port. Unlike the expandable sealing materials, the sand/gravel is not intended to completely fill the borehole.

In the context of the invention, the term "packer" should be construed as including not only a sealing packer that uses expandable sealing material such as bentonite, but also a filter-screen packer that uses sand or gravel.

BASIC FEATURES OF THE INVENTION

In the invention, the packer is not made up on-site, but is pre-manufactured, in a factory. The packer comprises an inner sleeve and an outer sleeve, and the packing material is located in the annular chamber between the two sleeves.

The packer is shipped to the field site for assembly onto the pipe, and for installation into the borehole. As such, at the time the packer is manufactured, the packer does not have the benefit of the presence of the pipe. Therefore, the designer must provide some means whereby the packer can be physically supported to the degree of robustness required for handling and transport of the packer.

In one aspect of the invention, the pre-manufactured packer has a structural-robustness-member incorporated into the structure thereof.

The structural-robustness-member may comprise the inner sleeve of the packer, the inner sleeve in that case being made of rigid material, such as metal.

The structural-robustness-member may comprise a shipping-tube, e.g of cardboard, which fits inside the inner sleeve. In this case, the inner sleeve may be thin plastic mesh.

Another aspect of the invention lies in a procedure for making and installing an expanding sealing packer. Here, the bentonite (or other water-expandable material) is compressed to sufficient pressure that the material coheres, and the material is thereby compression moulded into the shape of an annular-ring.

The annular-ring, or several annular-rings, are placed inside a sleeve, preferably of flexible plastic mesh material, to form the packer.

The annular-rings being rigid and robust, the rings themselves may serve to give the packer the required degree of structural robustness.

DETAILED DESCRIPTION OF PREFERRED EMBODIMENTS

By way of further explanation of the invention, exemplary embodiments of the invention will now be described with reference to the accompanying drawings, in which.

The apparatuses shown in the accompanying drawings and described below are examples which embody the invention. It should be noted that the scope of the invention is defined by the accompanying claims, and not necessarily by specific features of exemplary embodiments.

Figure 1:
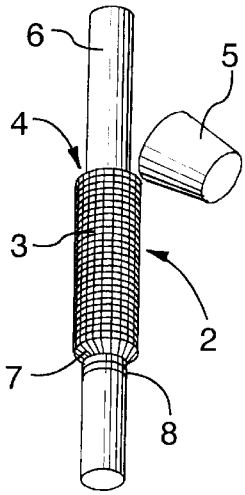
FIG.1 (PRIOR ART)
FIG. 1 is a diagrammatic view, showing one of the conventional ways in which the annular gap between pipe and borehole has been sealed.

FIG. 1 shows a prior art system, in which a packer, on a pipe, is being filled with packing sealant (bentonite) in the form of dry granules. The mesh is fine enough that the dry granules of bentonite are contained.

In FIG. 1, the task of filling the packer 2 is done actually on-site. To fill the packer, the technician holds the top of a mesh sleeve 3 open, to form a mouth 4, and carefully pours the grains of bentonite, from a container 5, into the mouth of the sleeve. The pipe 6 must be held more or less vertically, for pouring. The technician then clamps the mouth closed, before lowering the pipe, with the sleeve attached, down into the borehole.

The mesh material of the sleeve 3 is elastic, i.e expandable. Prior to filling, the (tubular) sleeve of mesh is prepared, and the technician slides the sleeve lengthwise along the pipe 6 to the desired location. The bottom end of the mesh sleeve is secured to the pipe. Securement can be done by gathering the bottom end 7 of the mesh sleeve around the pipe, and clamping it in place, using an elastic band 8 or other suitable securing means.

The band 8 serves to locate the sleeve 3 at its correct location on the pipe 6, as well as to close off the bottom end 7 of the sleeve. The top end of the sleeve is secured to the pipe with a similar elastic band, after filling, which serves also to locate the packer securely on the pipe.

Typically, the pipe 6 is a sampling pipe, for drawing off samples of water from various depths of a well, for analysis. The pipe may be a continuous length, or may be in screw-together sections. The pipe may be rigid or flexible.

Generally, many packers are assembled onto one pipe. The packers may be assembled to the pipe while the pipe is spread out on the ground surface, or the packers may be assembled to the pipe one by one as the pipe is being lowered down into the borehole. The assembly of several expandable packers and/or filter-screen packers is done in sequence, the assembly taking place all from one end of the pipe, or from the centre outwards from both ends. The packers need not all be of the same length, in that the technician may cut off suitable lengths of sleeve material, individually for each packer.

Filter-screen packers of sand/gravel are done in the same way as expandable packers of bentonite. The mesh size of the sleeve material should be suitable for the grain size of the medium being used.

In the conventional FIG. 1 system, it is known to simplify the task of forming the packer, by providing a packer-former. The packer-former comprises a thin-walled tube, which is slid along the pipe, and inserted into the sleeve, prior to pouring in the grains of bentonite or sand. The packer-former holds the mesh sleeve in the desired right-cylindrical form, and holds the mouth of the sleeve open, while the grains of packing material are being poured into the mouth. The packer-former is removed from the pipe after pouring.

In the conventional system, much skill and attention is required to ensure that every packer is correctly and evenly filled.

Figure 2:
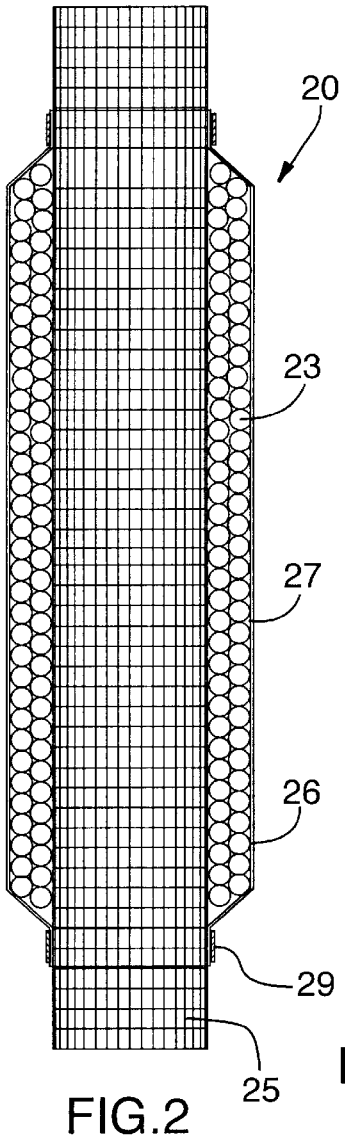
FIG. 2 is a side elevation of an apparatus for use in the invention, for introducing bentonite expandable material into the annular gap between the pipe and the borehole.

FIG. 2 shows a pre-made packer 20, which is the subject of the present invention.

Granules 23 of bentonite now are contained in a container-structure, which comprises an inner sleeve 25 of rigid (e.g stainless steel) mesh, and an outer sleeve 26 of an elastic (e.g thin flexible plastic) mesh. The granules 23 are contained in the annular chamber 27 between the two sleeves.

The pipe 28 is not present at the time the pre-made packer 20 (i.e the structure as shown in FIG. 2) is manufactured and assembled. The manufacture and assembly of the FIG. 2 unit is carried out in-factory.

The pre-manufactured packer 20 of FIG. 2, as an integrated unit, though of course not completely damage-proof, does have enough strength and rigidity as to be self-supporting to the extent necessary to enable assembly of the structure over the pipe 28, and to enable movement of the structure along the pipe to its designed location. The pre-manufactured packer 20 is strong enough to be handled, transported, and installed onto the pipe.

Binding clamps, which nip the outer mesh sleeve 26 and the inner mesh sleeve 25, comprise tightenable clamp rings 29, or may comprise other suitable means for attaching the sleeves together. Like the rest of the structure, the clamp rings 29 do not have to support large or abusive forces, and can easily be made robust enough for easy manufacture, transport, and fitment. Sometimes, the flexible mesh is such that the strands of the outer sleeve 26 can be interlaced into the strands of the inner sleeve 25, and a separate clamp ring to hold the sleeves together can thereby be avoided.

Bentonite granules do not swell immediately and rapidly upon coming into contact with water, and there is enough time for the pipe, with a string of packers located thereon, to be lowered down into the borehole, right down to the bottom. The outer diameter of the expandable packers 20, as pre-manufactured in the factory, should be smaller than the borehole in order to permit the pipe with the packers attached to be easily lowered down into the borehole, without snagging. Generally, a bentonite packer, once immersed in water and expanded, cannot later be contracted and removed.

Figure 3:
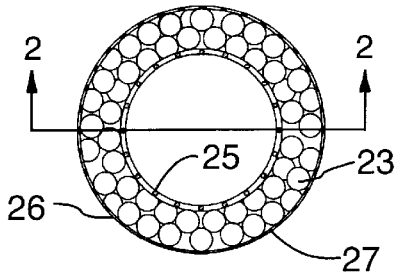
FIG. 3 is an end view of the apparatus of FIG. 2.
Figure 4:
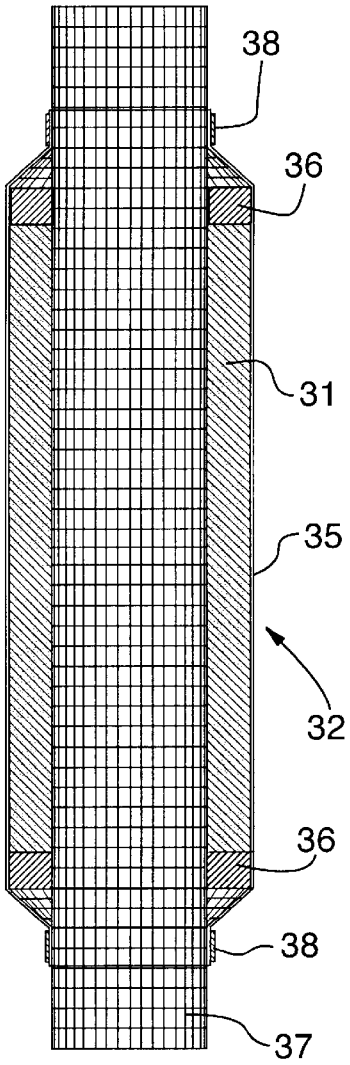
FIG. 4 is a side elevation of a similar apparatus, for introducing sand or other porous filter/screen material into the annular gap between the pipe and the borehole.

FIG. 4 shows a similar structure, but in which the bentonite 23 has been replaced by sand or gravel 31. The pre-made packer 32 of FIG. 4 is intended, not as a borehole seal, but as a filter or screen, and is used at a location in the sampling apparatus from which it is desired to draw off a sample of water. The pipe 28 (FIG. 5) furnished with an appropriate draw-off port, through which the water flows into the pipe, and the filter-screen packer 32 is provided in order to prevent particles of dirt etc, from the surrounding ground, from entering the port. The filter-screen packer also serves the purpose of keeping the port open to a relatively large area of surrounding water.

Again, the outer diameter of the filter-screen packer 32 also has to be smaller than the borehole, to permit installation without snagging. Of course, the filter-screen packer 32 of FIG. 4 does not expand upon contact with water, as did the bentonite in the sealing packer 20 of FIG. 2. If a pipe were to have only non-expandable filter-screen packers located thereon, if desired the pipe might later be removed from the borehole.

As shown, the expandable bentonite packer 20, of FIG. 2, with the water-swelling bentonite, has an outer sleeve 26 of flexible mesh. The outer mesh may be of fine plastic, for example. The mesh is such that it can be expected that, as the bentonite granules 23 expand, so the flexible mesh 26 will expand also. If the outer sleeve were rigid, the bentonite might be inhibited in its ability to expand freely to fill the annular gap between the pipe 28 and the wall of the borehole, depending on the mesh size, and other parameters. However, it is not ruled out that the designer might prefer to provide a rigid mesh for the outer sleeve of the expanding packer, and let the bentonite extrude through the holes in the mesh.

In FIG. 4, as in FIG. 2, the inner sleeve 25 may be of rigid material (e.g stainless steel, or rigid plastic), whereby the inner-sleeve can provide structural stiffness for the pre-made packer prior to its installation on the pipe.

In the case of the filter-screen packer 32, of FIG. 4, it is preferred that the outer sleeve be rigid. If, in the sand/gravel filter-screen packer 32, the outer sleeve 35 were flexible, the sand/gravel might be able to move, and the technician could not be sure that the material was correctly placed, after the apparatus has been lowered into the borehole.

Especially when the outer sleeve 35 is rigid, as in FIG. 4, end-spacers 36 should be provided, for locating the outer sleeve 35 relative to the inner sleeve 37. The material of the (rigid) outer sleeve 35, during manufacture of the packer, is drawn or gathered together at the ends of the outer sleeve, for attachment to the inner sleeve. The presence of the end-spacers 36 ensures that the outer sleeve is maintained to the desired configuration over most of the length of the outer sleeve, despite being gathered in at the ends.

The outer sleeve 35 is drawn around the inner sleeve 37, and secured in place, either with a clamp ring 38, or by spot welding the inner and outer meshes together (if the materials are amenable to welding) or by mechanically weaving strands of the two mesh sleeves together. Even when the outer sleeve 35 is made of metal mesh (FIG. 4), it is still possible to deform the metal, and bring the outer sleeve inwards and into contact with the inner sleeve—and of course this can be done when the outer sleeve is of flexible mesh (FIG. 2).

The expandable packer 20 and/or the filter-screen packer 32 can be secured into the desired location on the pipe 28, by suitable means, such as clamps 39, at the ground surface, prior to lowering the pipe down the borehole.

The manufacture of the expandable packer 20 and of the filter-screen packer 32 takes place in a factory, when no pipe is present. The in-factory manufacture can be automated to a large degree, using jigs and fixtures, automatic filling machinery, etc. This may be contrasted with the task, as described as required in conventional systems, where the technicians have to cope with the task of pouring bentonite grains into an annular former placed around the pipe, in the field.

As mentioned, the inner sleeve 25,37 may be rigid, to provide structure and robustness to the pre-made packer. The inner sleeve should be a little larger than the pipe 28 for which it is intended, to allow the manufactured structure to be assembled over the pipe, and to slide along the pipe. The pipe can be expected to be consistent as to its diameter, so the clearance of the inner sleeve around the pipe need not be large. By contrast, the borehole (that is to say, the liner of the borehole) is likely to contain considerable distortions and variations as to its diameter, roundness, etc, over the whole depth of the borehole, and the outer sleeve 26,35 should be considerable margin of tolerance smaller than the nominal diameter of the borehole.

Figure 5:
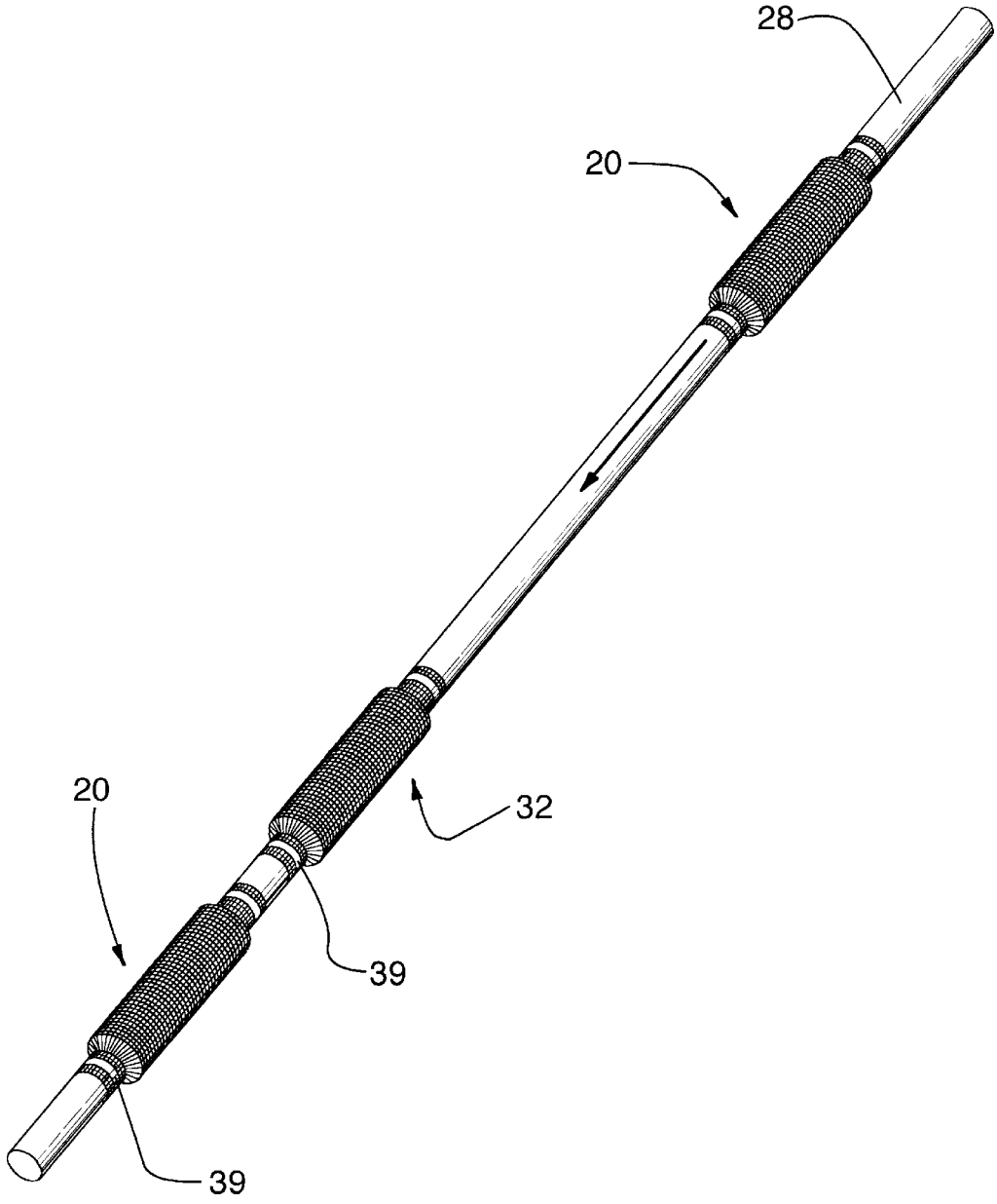
FIG. 5 is a pictorial view, showing the placement of a FIG. 2 apparatus and a FIG. 4 apparatus on a pipe.

FIG. 5 shows a typical installation on a pipe, around a sampling port. A filter-screen packer 32 has been secured over the port-hole in the pipe 28 (in FIG. 5 the port-hole is hidden by the screen-filter packer). An expandable bentonite packer 20 has already been secured to the pipe just below the sampling port, and another bentonite packer is being assembled along the pipe to a location just above the sampling port. This seal-port-seal configuration is very common in sampling installations. The pipe may contain several of the seal-port-seal configurations along the length of the pipe, for multi-level sampling.

The sealing-packers placed above and below the sampling ports should be securely watertight, in the borehole. If not, the integrity of the sample can be lost, as regards the depth from which the sample was truly taken.

The filter-screen packer 32 is typically about 40 or 50 cm long, and the expandable sealing packers 20 are about the same. Sometimes, the sealing packers may be much longer. The vertical space between the upper sealing packer of one sampling port and the lower sealing packer of the next port above, can be several metres. Thus, an open annular space (between the pipe and the borehole liner) is created, which bridges much of the distance between adjacent sampling ports.

Consequently, even though the sealing packers may be completely watertight, still, water can flow several metres vertically, though the open annular space, between the sampling points, with much less resistance than it can flow through several metres of the undisturbed (and stratified) surrounding soil. In some cases, the effect of this long open annulus, between the sealing packers, on the integrity of the readings is enough to justify placing sealing packers which seal along more or less the whole length of the pipe, between the sampling ports.

The system using the pre-made sealing packers, as described herein, is well-suited to the provision of such long packers, i.e of sealing packers whose length is measured in metres. It will be understood that metres-long packers were out of the question when the technician had to fill the packers by hand, in the field (FIG. 1), by pouring grains of bentonite into an annular mouth, from one end.

The pipe 28 on which the packer 20,32 is assembled may be flexible or rigid. The pipe may be all in one piece, or may be in join-together sections. Generally, the pipes used for extracting samples from wells, even when in join-together sections, are right-cylindrical, smooth, and have no protrusions, whereby it is a simple matter for the technician to slide the packer along the pipe to its desired location. If the pipe were to have protrusions, e.g at joining points, each packer would have to be assembled to its pipe-section before the pipe-sections were joined together. This is not preferred, but it is not ruled out.

In the drawings, the mesh of the sleeves is shown with the strands of the mesh going lengthwise and hoop-wise. For better circumferential flexibility and expandability of the mesh, the designer may prefer to arrange the strands diamond-wise.

As shown in FIG. 4, an annular end-spacer 36 may be placed between the inner sleeve 37 and the outer sleeve 35, at the ends of the packer 32. The end-spacer 36 is rigid, or almost rigid, and serves to ensure that the annular gap between the inner sleeve and the outer sleeve is even, all around the circumference, and remains so during storage and transport of the manufactured unit, and during assembly of the packer to the pipe. One of the functions of the spacer arises in that it is important that the pipe be at least approximately in the middle of the borehole, i.e co-axial with the borehole, whereby the radial thickness of the packing seal material is at least approximately the same at all orientations.

Bentonite can be expected to swell to as much as five or six times its dry volume, when immersed in water. If the bentonite is contained, therefore, the bentonite can be expected to make a very tight and secure seal between the pipe and the borehole. However, if the bentonite is not constrained in the axial direction, that might reduce its ability to build up a large expansion pressure, and to make a tight annular seal. For the sealing packer 20 to make a proper, secure seal in the annular space between the pipe and the borehole, the designer should aim to confine the bentonite axially. Therefore, the designer should prefer to install, at each end of the packer, a means for confining the bentonite, i.e a means for preventing the bentonite from expanding axially. The end-spacer 36 of FIG. 4 can perform this function, serving as an end-closure-means.

Figure 6:
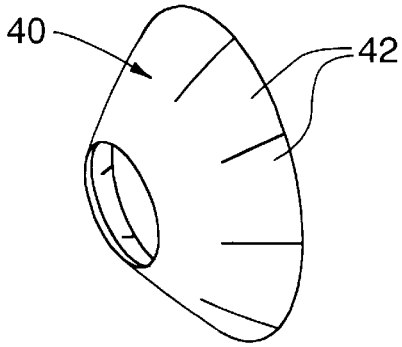
FIG. 6 is a pictorial view of an end-closure means.
Figure 7:
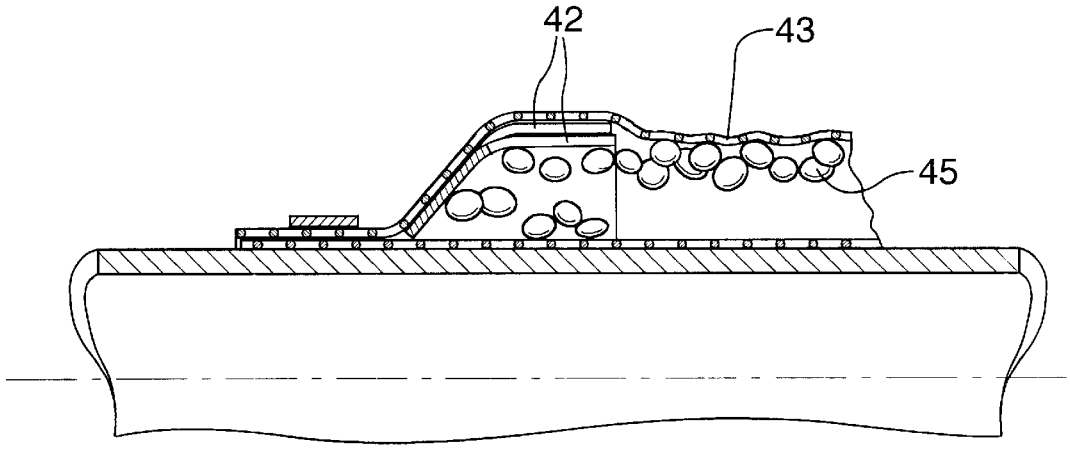
FIG. 7 is a side elevation of a packer that incorporates the end-closure means of FIG. 6.
Figure 8:
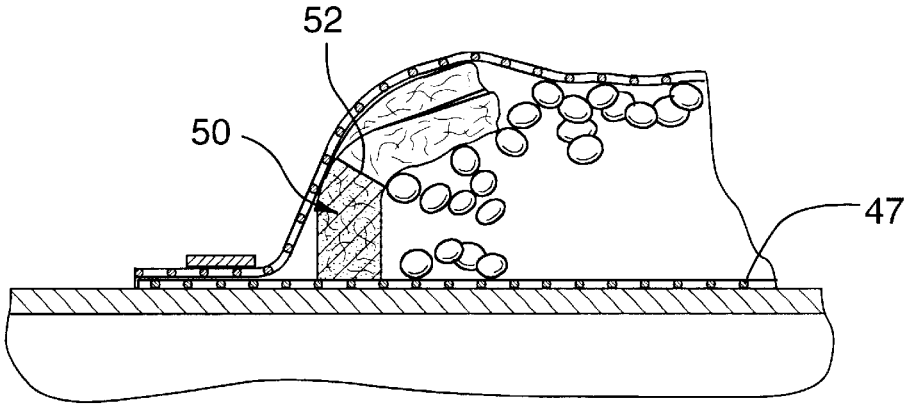
FIG. 8 is a side elevation of a packer that incorporates another kind of end-closure means.

Other end-closure-means, for containing the bentonite against axial expansion, are illustrated in FIGS. 6 to 8. The designer must compromise the requirement for the end-closure-means to fill the annular space, with the requirement that the outer diameter of the outer sleeve, and of the end-closure-means, must be considerably smaller than the diameter of the borehole, to give clearance to permit the not-yet-expanded packer to be inserted into the borehole without snagging.

Preferably, the design of the end-closure-means should be such as to permit the end-closure-means also to expand, as the bentonite expands, so that the end-closure-means can fit tightly against the sides of the borehole, in order to produce an effective containment for the expanding bentonite.

In the filter-screen packer of FIG. 4, the end-closure-means is simply the solid ring 36 of plastic, which is non-expandable in itself. This is fine for a non-expanding filter-screen packer 32, but it is not preferred for a bentonite sealing packer 20, because here the expanding bentonite does have an escape path, around the edges of the ring. However, the solid ring is very simple, and is better than nothing, even for an expanding sealing packer.

In FIG. 6, the end-closure-means comprises a piece 40 of plastic, which is arranged in a cone. The outer margins of the cone are cut into fingers 42. When the bentonite is dry, the fingers lie flat, i.e axially, being held by the hoop-constraint of the mesh of the (elastic) outer sleeve 43, as shown in FIG. 7. As the bentonite 45 expands, so the mesh of the sleeve 43 expands; this allows the (springy) fingers 42 to open outwards, and into contact with the borehole wall.

In FIG. 8, the end-closure-means comprises a piece of geotextile material. Geotextile material is chemically inert in water. That is to say, the material is not itself affected by water, nor by any of the (toxic) chemicals that can be encountered, in trace quantities, in groundwater, i.e down boreholes. Equally, the material does not release, into the water, any chemicals that might affect the integrity of the samples being taken for analysis.

The geotextile material may be a thin fabric, which has virtually no rigidity in itself. The piece of thin material is formed as a simple circle, with a central hole. The piece is folded and gathered around the inner sleeve, and clamped thereto. While the bentonite is dry, the elastic outer sleeve holds the folds of the thin geotextile fabric piece against the outer sleeve. But the folding and gathering is loose enough to permit the fabric material to unfold, and to fill the borehole, as the bentonite, and the outer sleeve, expand.

In FIG. 8, the geotextile material is thicker, being thick enough to have a significant stiffness, such that it cannot be gathered into tight folds. The piece 50 of thick material is circular, and the outer circumference is formed with slits 52 as in FIG. 6. When the packer is dry, the thick material lies bent over and squeezed radially by the elastic outer sleeve 47 as in FIG. 8, but the material can open out radially when the outer sleeve expands radially with the bentonite.

As mentioned, the pre-made packer has to be robust enough to stand up to handling and assembly of the packer onto the pipe. This aspect will now be further considered. If the pre-manufactured packer were to have both sleeves made of elastic mesh, i.e mesh having no structural rigidity in itself, the packer would not be suitable for handling and transport. The cross-sectional configuration of the packer is intended to be an annulus, and it is important that this configuration be still present when the time comes to assemble the packer onto the pipe. If, for instance, the annulus had collapsed during handling and transport, the task of assembling the packer over and onto the pipe, even if still possible, would be very difficult, and considerably more skill and careful manipulation would be required of the technician.

The design of the packer should be such that a reasonably careful technician would be unlikely to cause damage to the packer when handling the packer and when assembling the packer onto the pipe.

If the packer did not robustly hold its shape, when being transported and handled, a not-so-careful technician might damage the packer, during assembly to the pipe, causing the bentonite to spill out.

In FIG. 2, the granules 23 of bentonite are moulded spheres, of about one centimetre diameter. The designer may prefer other diameters, and other shapes. The mesh of the inner and outer sleeves 25,26 should be selected to contain the spheres. As the body of bentonite expands, upon contact with water, the flexible-mesh expands, and the remaining hard centres of the spheres become smaller; and it can happen that the bentonite spheres might tend to pop out through the holes in the mesh. The mesh should be tight enough to resist this. The mesh should not be too tight, however, in that the wet bentonite (which has a pasty consistency) must be able to squeeze through the holes in the mesh, and into sealing contact with the walls of the borehole.

Similarly, the holes in the mesh of the inner sleeve 25 should permit the wet bentonite to make tight sealing contact with the outer surface of the pipe 28.

Flexible expandable mesh is preferred for the outer sleeve 26 of an expanding sealing packer 20. However, it is not ruled out that the designer may specify rigid (metal) mesh in that case; when the mesh of the outer sleeve is rigid, although the bentonite can extrude through the holes in the mesh, the resulting mass of bentonite is much less coherent than bentonite that has expanded outwards as a body, carrying the expandable mesh outwards.

When the packing material is sand 31 (FIG. 4), the holes in the mesh should be small enough that the sleeve contains the grains. A filter-screen packer 32, containing sand, is not intended to expand and to touch the walls of the borehole. However, the sand, like the bentonite, preferably should press tightly inwards, against the outer surface of the pipe 28, since its function is to screen out solid particles from entering the sampling port. The designer preferably should select the mesh size of the inner sleeve 37 such as to permit the grains to protrude inwards slightly through the holes, whereby the grains can make direct contact with the pipe.

The designer of a filter screen packer 32 may arrange the mesh size of the inner sleeve such that only the metal of the inner sleeve actually touches the pipe, while the actual grains of sand are held clear. However, that is not preferred, in that the screening should be done by the grains of sand, not by the sleeve.

The greater the surface of the bentonite exposed to the water, the faster the expansion will take place. It is important that the designer sees to it that the rate of expansion is slow enough that the technician has no problem installing the pipe to the bottom of the borehole before the expanding bentonite locks the pipe into the borehole, but yet fast enough that the technician is still present, to check that the pipe is properly installed as an on-going aspect of the installation procedure.

In the designs as depicted in FIGS. 2 and 4, the stiffness and robustness the pre-manufactured packer needs, in order to be handleable, transportable, and assemblable onto the pipe, comes from the fact that the inner sleeve 25,37 is of metal.

The designer will generally prefer that system for the filter-screen (sand) packers 32. However, the use of metal (stainless steel) sleeves can be expensive. The pre-manufactured packer must have structural robustness, but it is recognised that there are other ways of achieving robustness without resorting to expensive metal mesh for the inner sleeve. The designer may prefer to use flexible plastic mesh for the inner sleeves as well as for the outer sleeves, when it comes to the expandable sealing (bentonite) packers. However, if the inner sleeve is flexible, preferably some other means must be provided for imparting the required structural robustness to the packer.

Figure 9:
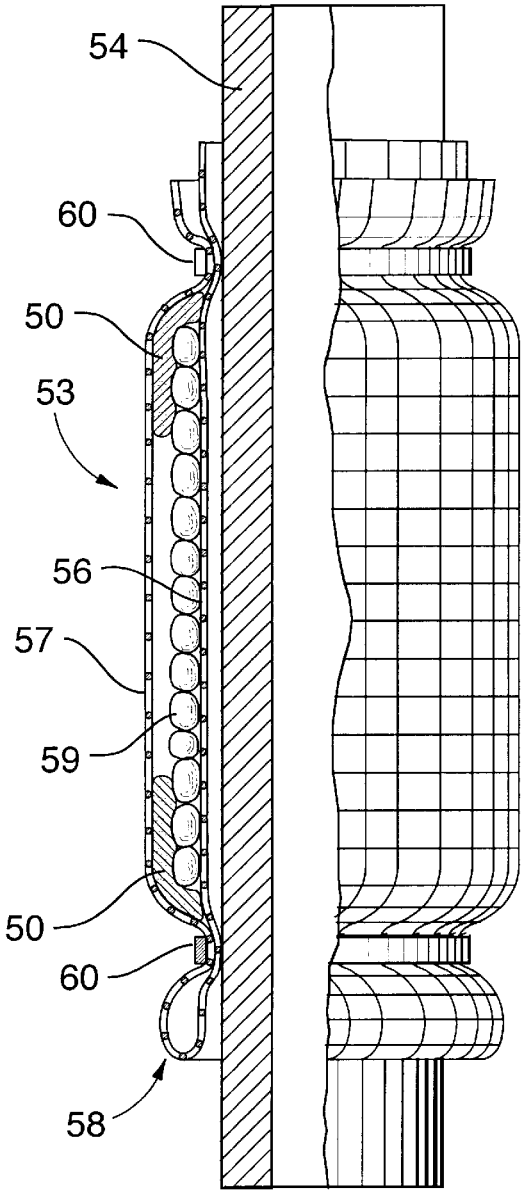
FIG. 9 is a side elevation of a packer in which inner and outer sleeves are formed in one piece.

FIG. 9 shows an expandable sealing (bentonite) packer 53, in which the structural-robustness-member takes the form of a cardboard tube 54. The packer 53 is built up, in the factory, around the cardboard tube. The inner and outer sleeves 56,57 are both made from flexible plastic mesh. The mesh is in the form of a tubular stocking 58, which is cut to a length of roughly double the desired length of the packer. The tubular stocking 58 is placed over the cardboard tube 54, and the bentonite granules or spheres 59 are placed around the stocking, where they are held in place in a suitable jig. Then, the stocking 58 is doubled over, i.e turned inside out, and rolled over the granules. Thus the stocking 58 forms both the inner sleeve 56 and the outer sleeve 57.

The upper and lower ends of the sleeves are secured to the cardboard tube 54 by means of plastic clips or clamps 60. These clips are of the kind that can be tightened and locked in place.

An expandable sealing packer 53 built around a cardboard shipping tube, as shown, is robust, and can be handled and transported without difficulty.

One of the critical moments that requires the structure of the packer to be robust occurs when the packer is being assembled onto the pipe. Preferably, the cardboard tube 54 and the pipe 28 should have the same external diameter. That being so, the technician can slide the components of the packer, as an intact unit, off the cardboard tube, and onto the pipe. Of course, the technician must devote some skill to this task, but the task is by no means demanding, and the technician can expect to do it right every time, with the exercise of just a little care.

The clips 60 should be done up tightly enough, in the factory, to hold the sleeves 56,57 to the cardboard tube 54, but not so tightly that the technician cannot slide the sleeves off the tube. Once the packer is in position, at its desired location, on the pipe, the clips can be fully tightened. In fact, the clips need not be absolutely locked to the pipe, since ultimately it is the tightness arising from the expansion of the bentonite that holds the packer in place, not the tightness of the clips.

The packer of FIG. 9 includes upper and lower end-closure-means of thick geotextile material 50, which are disposed as shown in FIG. 8.

The cardboard tube 54 is not assembled along the pipe, and, once the packer 53 has been transferred to the pipe 28, the tube 54 is discarded. In an alternative, the cardboard tube is larger than the pipe, and slides along the pipe with the rest of the pre-manufactured packer. Once in place, the technician withdraws the cardboard tube, axially, out of the packer. The tube may be cut away and discarded, or may be slid along the pipe, and discarded from the end of the pipe. The technician then clamps the clips 60 tightly to the pipe. In this case, the flexible plastic mesh material of the sleeves should be stretchy enough that, even when the cardboard tube is withdrawn, the sleeves contract, and urge the bentonite into tight contact with the pipe. The inner sleeve should not be loose on the pipe.

The cardboard tube should not be left on the pipe. Even if the cardboard degrades after a period of time under water, and disappears, the cardboard might leave chemicals in the water that might compromise the water samples.

Figure 10:
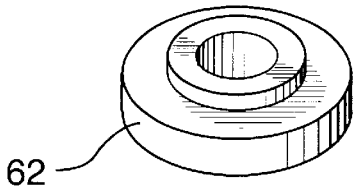
FIG. 10 is a pictorial view of a moulded annular-ring.

FIG. 10 shows another manner in which bentonite can be prepared, in-factory, that is useful in the invention.

The bentonite in FIG. 10 has been formed into an annular-ring 62. The ring 62 is formed by being compressed, under high pressure, in a mould. The bentonite is placed in the mould as dry powder, and subjected to a heavy compression. Good results have been obtained when the powder has been subjected to a bulk compressive stress of about 3500 psi.

To make the expandable sealing packer 63 (FIG. 11), several of the moulded annular-rings 62 of bentonite are assembled into a stack 64, and placed over a cardboard tube 65. Thick geotextile end-closure-means 50 are again employed. Clips 60 may be employed to hold the packer 63 to the cardboard tube 65, or, as shown in FIG. 10, the plastic mesh stocking 67 can be left folded over at the ends, the mesh clamping tightly enough on to the geotextile material, and the geotextile material clamping tightly enough onto the cardboard tube, for the packer to be secure enough for handling and transport, as a unit.

Upon assembly onto the pipe 28, again the cardboard tube 65 is withdrawn and discarded. The plastic mesh material 67 is unrolled into contact with the pipe, and held in place on the pipe with plastic clips or clamps 60.

Figure 12:
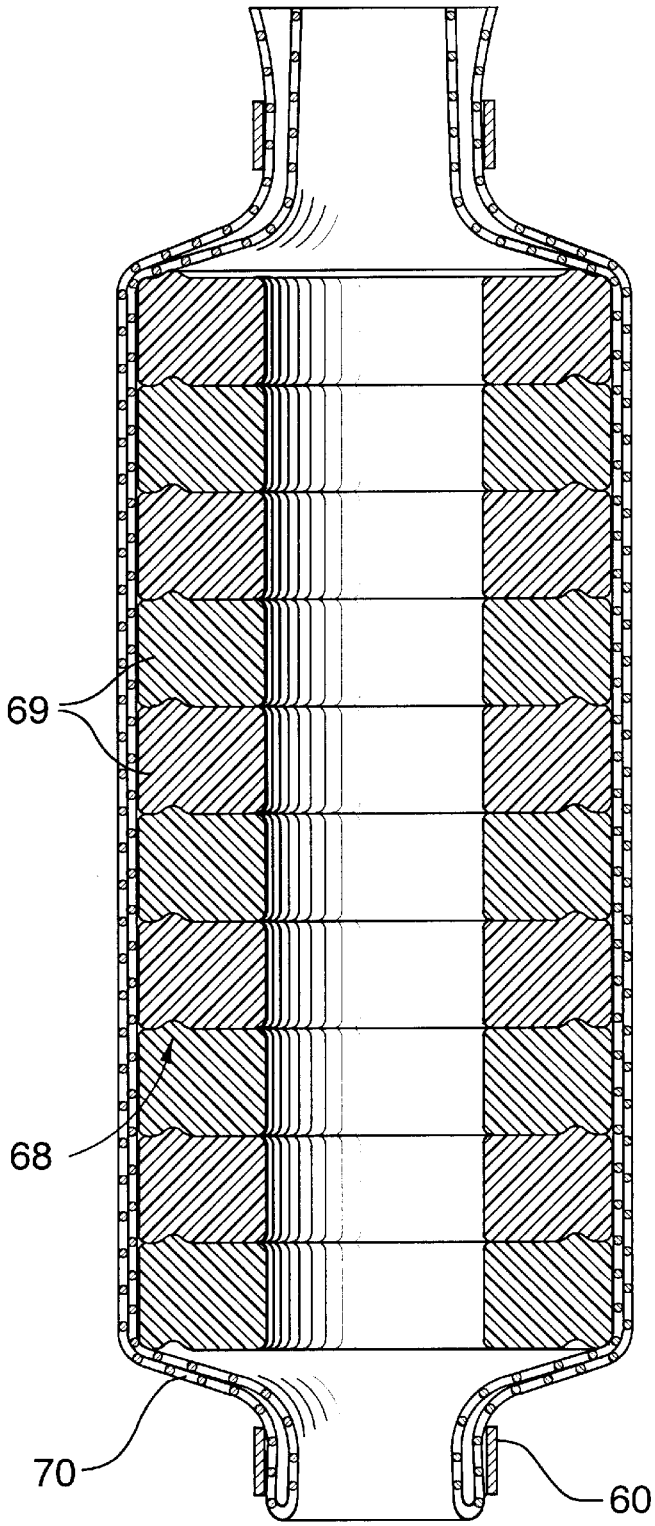
FIG. 12 is a cross-section of a packer apparatus that comprises a stack of other annular-rings.

FIG. 12 shows another variation. Here, a shipping-tube is not needed, because the stack 68 of annular-rings 69 has enough structural rigidity, in itself, at least when held together by the flexible plastic mesh sleeve 70, to be suitable for handling, transport, and assembly to the pipe. The annular-rings 69 are assembled into the stack 68, and the stocking 70 of flexible mesh is stretched over the stack. The fact that the mesh is stretched, both circumferentially and axially, is enough to keep the stack 68 of rings intact.

The force on the stack 68, from the mesh 70, need only be quite small, and yet the stack is held together securely—enough, at any rate, for the stack to be robust enough for handling and transport and assembly to the pipe.

One benefit of the FIG. 12 arrangement is that no possibly-vulnerable stage arises, during the transfer of the annular-rings onto the pipe, when the packer might be rather vulnerable to carelessness by the technician. The stack of annular-rings remains just as secure, whether off or on the pipe.

In FIG. 12, again, the geotextile material may be formed into end-closure-means for the stack 68, and again the over-turned ends of the sleeve 70 may be unrolled and clamped, with plastic clips 60, to the pipe, once the packer is installed at its final desired location along the pipe.

Figure 11:
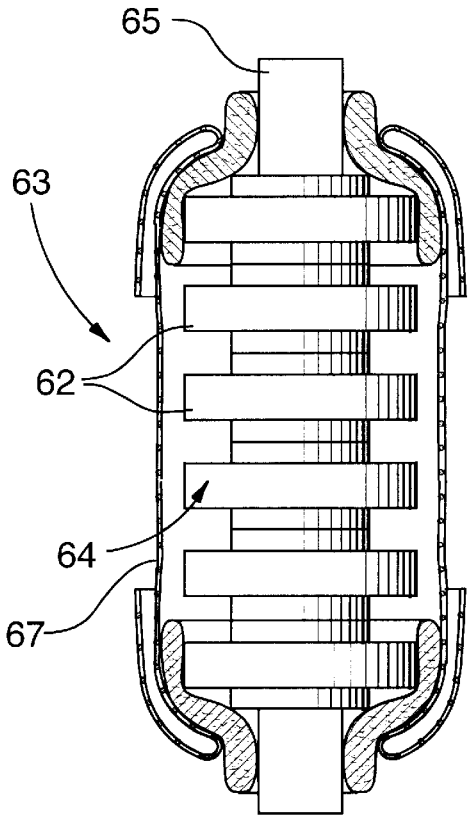
FIG. 11 is a cross-section of a packer apparatus that comprises a stack of the annular-rings as shown in FIG. 10.

The moulded annular-rings may be shaped to occupy the whole space between the inner and outer sleeves, as shown in FIG. 12, or may be shaped so as to define spaces between the rings, as in FIGS. 10 and 11. The more surface area of bentonite that is exposed to water, the faster the bentonite can be expected to expand, when it is immersed in water. The designer should determine the optimum time, and should set the exposure area accordingly.

The moulded bentonite in which the annular-rings are formed is hard, and strong enough for the rings to retain their shape during normal handling. The strength of the compression-moulded rings is such that, if a person grasps the ring in his hands, he can fairly readily break a piece off, by hand manipulation.

Where a number of rings are to be used together, it might be considered that an axially-long cylinder of bentonite could be moulded as a single component. However, this is not preferred, because the longer the component, the more fragile it would become.

It should be noted that when bentonite is subjected, in a mould, to such heavy bulk compression that the grains of bentonite cohere, that the bonds between the grains are not completely stable. Thus, when the compression-moulded rings are wetted, the expansion tends to take place along the grain boundaries, whereby the moulded rings tend to burst, quickly, rather than to expand at a uniform slow rate. The designer should note this is determining the wetting time.

Preferably, the bentonite packers as described herein should be wrapped in plastic film, of the type that clings to the wrapped article. This serves two purposes: first, to keep the bentonite dry if it should be raining when the task of installing the packers is being carried out; and second, the film wrapping acts to give further structural, or at least protective, support to the packer, during handling and transport. Of course, the plastic film must be removed before the packer is lowered down into the borehole.

What is claimed is:

1. Pre-manufactured packer apparatus, wherein:

the apparatus as a whole comprises a structure that is structurally suitable for fitment over and around a long pipe; for securement to the pipe at a pre-determined location along the length of the pipe; and, when secured to the pipe, for installation from the ground surface down into a borehole in the ground and under water in the borehole;

the apparatus consists of components;

the apparatus does not include the pipe, in that the pipe is not one of the components of the apparatus;

an operable securement means, which is effective, when operated, to secure the apparatus to the pipe, comprises one of the components of the apparatus;

an inner cylindrical-sleeve and an outer cylindrical-sleeve comprise components of the apparatus, which are so arranged as to form an annular chamber therebetween;

first and second end-closure-means comprise components of the apparatus, which are effective to close respective axial ends of the annular chamber;

a body of packer material comprises one of the components of the apparatus, which is located inside the annular chamber, in that the body is physically contained, radially-annularly and axially, between the inner and outer sleeves and the end-closure-means;

the outer sleeve is perforate, to the extent that water can enter, and can make contact with the packer material, through apertures in the outer sleeve, when the securement means is operated to secure the apparatus to the pipe, and placed in water;

a structural-robustness-member comprises one of the components of the apparatus, which is of cylindrical form, and which extends over substantially the whole axial length of the annular chamber;

the structural-robustness-member is of such structural robustness in itself, and is so integrated with the other components of the apparatus, as to provide robust structural support to the apparatus as a whole, thereby giving the apparatus enough rigidity and robustness for the apparatus to be handled and transported, and to survive at least minor knocks and abuse.

2. Apparatus of claim 1, wherein the packer is an expanding sealing packer, and the packer material is material that swells upon being immersed in water.

3. Apparatus of claim 2, wherein at least one of the end-closure means is so arranged, in the apparatus, as to restrain the material from expanding axially.

4. Apparatus of claim 3, wherein the end-closure-means is so structured as to be able to expand radially, whereby the end-closure-means can follow the expansion of the expandable material, providing constraint against axial expansion of the expandable material, axially beyond the end-closure-means.

5. Apparatus of claim 4, wherein the end-closure-means is made of a geotextile fabric material, which is generally disc-shaped, with radial fingers, and the fingers overlie each other when the material is unexpanded.

6. Apparatus of claim 2, wherein the outer sleeve is of flexible mesh material, and the outer sleeve can expand, and can follow, at least partly, the movement the expandable packer material undergoes when it makes contact with water and swells.

7. Apparatus of claim 1, wherein the packer is a filter-screen packer, and the packer material is sand or gravel.

8. Apparatus of claim 1, wherein the nature of the other components of the apparatus is such that, without the structural-robustness-member, the apparatus has too little structural robustness to be suitable for handling and transportation.

9. Apparatus of claim 1, wherein the structural-robustness-member is located radially inside the annular chamber.

10. Apparatus of claim 9, wherein the structural-robustness-member comprises the inner sleeve, the inner sleeve being made of metal, and being rigid.

11. Apparatus of claim 1, wherein the structural-robustness-member is removable from the other components of the packer apparatus upon assembly of the apparatus to the pipe.

12. Apparatus of claim 11, wherein:

the structural-robustness-member comprises a shipping-tube, made of rigid material, which is separate from, and fits inside, the inner sleeve;

and the shipping-tube is so integrated with the other components of the apparatus as to be detachable and removable from the other components.

13. Apparatus of claim 12, wherein the shipping tube is of cardboard.

14. Apparatus of claim 12, wherein the packer apparatus is arranged, for installation of the apparatus onto the pipe, such that the shipping-tube can be abutted against an end of the pipe, and the rest of the components of the packer can slide, as a unit, off the shipping tube, and axially onto the pipe, and can slide along the pipe.

15. Apparatus of claim 12, wherein the inner sleeve is of plastic mesh material.

16. Apparatus of claim 1, wherein the inner sleeve is perforate, to the extent that water can enter, and can make contact with the packer material, through apertures in the inner sleeve, when the container is secured to the pipe, and placed in water.

17. Apparatus of claim 1, wherein:

the outer sleeve is of plastic mesh material, having substantially no structural rigidity and robustness in itself;

the outer sleeve is resiliently stretchable, at least in the circumferential sense.

18. Apparatus of claim 1, wherein the annular chamber, and the packing material thereinside, is a plurality of meters long axially.

19. Apparatus of claim 1, wherein the structural-robustness-member, being of cylindrical form, is of such shape and dimensions as to hold the apparatus, when separate from the pipe, in an annular-cylindrical configuration.

20. Apparatus of claim 1, wherein the structural robustness member is comprised by the body of packer material, in that the packer material is itself structurally rigid.

21. Apparatus of claim 20, wherein:

the body of packer material includes a solid annular-ring;

the annular-ring is circumferentially complete, in that the annular-ring encircles a central hole, whereby the annular-ring can be assembled only lengthwise over and along the long pipe;

the annular-ring is solid in the sense that the annular-ring, as manufactured, has enough structural integrity that the annular-ring can be handled and transported, and can survive at least minor knocks and abuse.

22. Apparatus of claim 21, wherein the solid annular-ring has been pre-manufactured by being compressed in a mould.

23. Apparatus of claim 21, wherein the body of packer material includes a stack of solid annular-rings, and the structural robustness member includes a means for holding the annular-rings together axially.

24. Apparatus of claim 23, wherein:

the annular-rings that form the stack are so shaped that, when held together in the stack, the stack comprises a rigid cylinder;

and the apparatus includes a stack-lock, which is so structured as to hold the stack together in the axial sense.

25. Apparatus of claim 24, wherein the stack-lock comprises a sleeve of stretchable material, which is stretched over the stack of annular-rings.

26. Apparatus of claim 20, wherein the apparatus includes a cylindrical stocking of stretchy material, which is turned inside out, and folded over itself, whereby the stocking forms both the inner sleeve and the outer sleeve.

27. Apparatus of claim 1, wherein:

at at least one axial end of the outer sleeve, the outer sleeve is of a radially-reduced configuration;

that reduced end of the outer sleeve is in direct touching contact with the inner sleeve;

one of the end-closure-means includes an operable circumferential clamp;

the clamp is so structured and arranged in the apparatus that, when operated, the clamps is effective to clamp the reduced end of the outer sleeve to the inner sleeve.

28. Apparatus of claim 27, wherein the clamp is so structured and arranged in the apparatus that, when the apparatus is fitted over the end of a pipe, and moved to a pre-determined position along the pipe, the clamp is effective, when operated, to clamp the reduced end of the outer sleeve to the inner sleeve, and simultaneously to clamp both sleeves to the pipe.

29. Apparatus combining a long length of pipe, and a plurality of packers, wherein:

each one of the packers is so structured that it can be assembled over an end of the length of pipe, and can be moved lengthwise along the pipe;

the apparatus includes an operable lock, which is effective, when operated, to fix the packers to the pipe at pre-determined locations along the length of the pipe;

the apparatus is so structured, upon the packers being fixed to the pipe, as to be capable of being lowered down into a water-containing borehole in the ground;

in respect of each one of the packers:

the packer includes an inner sleeve and an outer sleeve, which are so arranged as to form an annular chamber therebetween;

the packer includes upper and lower end-closures, which are effective to close the axial ends of the annular chamber;

the packer includes a body of packer material, which is located inside the annular chamber, in that the body is physically contained, radially-annularly and axially, between the inner and outer sleeves and the upper and lower end-closures;

the outer sleeve is perforate, to the extent that water can enter, and can make contact with the packer material, through apertures in the outer sleeve, when the packer is placed in water;

the packer includes a structural-robustness-member;

the structural-robustness-member is of cylindrical form;

the structural-robustness-member extends over substantially the whole axial length of the annular chamber;

the structural-robustness-member is of such structural robustness in itself, and is so integrated with the other components of the packer, as to provide robust structural support to the packer as a whole, thereby giving the packer enough rigidity and robustness for the packer to be handled and transported, when physically separated from the pipe, and to survive at least minor knocks and abuse.

30. Combination of claim 29, wherein the pipe is formed as a single continuous length, having no joints.

31. Combination of claim 29, wherein the plurality includes a sampling-point-set of packers, comprising one filter-screen packer in which the packer material is sand or gravel, sandwiched between upper and lower expanding sealing packers, in which the packer material is material that swells upon being immersed in water.

32. Combination of claim 31, wherein the plurality includes a plurality of the sampling-point-sets.

* * * * *